US007757484B2

(12) United States Patent
Bruza et al.

(10) Patent No.: US 7,757,484 B2
(45) Date of Patent: Jul. 20, 2010

(54) EXHAUST TREATMENT DEVICE HAVING FLOW-PROMOTING END CAPS

(75) Inventors: Philip Stephen Bruza, Peoria, IL (US); Darrel Henry Meffert, Sahuarita, AZ (US); Michael James Pollard, Peoria, IL (US); Timothy John Boland, Eureka, IL (US); John Roger Weber, Chillicothe, IL (US); Ronak Dhanendrakumar Shah, Peoria, IL (US); Robert Lee Meyer, Metamora, IL (US); Jonas Arūnas Aleksonis, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 581 days.

(21) Appl. No.: 11/700,190

(22) Filed: Jan. 31, 2007

(65) Prior Publication Data

US 2008/0178585 A1 Jul. 31, 2008

(51) Int. Cl.
*F01N 1/00* (2006.01)

(52) U.S. Cl. ..... 60/324; 60/272; 60/274; 60/299; 60/300; 60/302; 422/169; 422/171; 422/176; 422/177

(58) Field of Classification Search ..... 60/272, 60/274, 299, 324, 300, 301, 302, 309, 311; 422/169, 170, 171, 172, 176, 177
See application file for complete search history.

(56) References Cited

U.S. PATENT DOCUMENTS

| | | | | |
|---|---|---|---|---|
| 4,343,149 | A | 8/1982 | Abthoff et al. | |
| 4,419,108 | A | 12/1983 | Frost et al. | |
| 4,455,823 | A | 6/1984 | Bly et al. | |
| 4,495,153 | A * | 1/1985 | Midorikawa | 422/171 |
| 4,504,294 | A | 3/1985 | Brighton | |
| D278,326 | S | 4/1985 | Equi | |
| 4,570,745 | A * | 2/1986 | Sparks et al. | 181/228 |
| 4,573,317 | A | 3/1986 | Ludecke | |
| 4,786,298 | A | 11/1988 | Billiet et al. | |
| 4,881,959 | A | 11/1989 | Kono et al. | |
| 5,144,797 | A | 9/1992 | Swars | |
| 5,248,482 | A | 9/1993 | Bloom | |
| 6,148,613 | A * | 11/2000 | Klopp et al. | 60/296 |
| 6,253,792 | B1 | 7/2001 | Williams et al. | |
| D454,614 | S | 3/2002 | Marston | |
| 6,464,744 | B2 | 10/2002 | Cutler et al. | |
| 6,551,385 | B2 | 4/2003 | Turner et al. | |
| 6,767,378 | B2 | 7/2004 | Nishiyama et al. | |
| 6,814,771 | B2 | 11/2004 | Scardino et al. | |
| 6,951,099 | B2 * | 10/2005 | Dickau | 60/300 |
| 7,174,707 | B2 * | 2/2007 | Megas et al. | 60/297 |
| 7,282,185 | B2 * | 10/2007 | Harris | 422/181 |
| 7,350,349 | B2 * | 4/2008 | Olofsson | 60/295 |
| 7,501,005 | B2 * | 3/2009 | Thaler | 55/523 |
| 7,614,215 | B2 * | 11/2009 | Warner et al. | 60/286 |
| 2005/0279571 | A1 | 12/2005 | Marocco | |

* cited by examiner

*Primary Examiner*—Binh Q. Tran
(74) *Attorney, Agent, or Firm*—Finnegan, Henderson, Farabow, Garrett & Dunner

(57) ABSTRACT

An end cap for an exhaust treatment device is disclosed. The end cap has a cylindrical housing with an axial direction, a radial direction substantially orthogonal to the axial direction, a first open end, and a second closed end opposing the first open end in the axial direction. The end cap also has an integral port member extending from an annular surface of the cylindrical housing. The integral port member has a central axis aligned in the radial direction, and an exterior surface of the integral port member tangentially connects to an exterior surface of the cylindrical housing.

20 Claims, 4 Drawing Sheets

EXHAUST TREATMENT DEVICE HAVING FLOW-PROMOTING END CAPS

TECHNICAL FIELD

The present disclosure is directed to an exhaust treatment device and, more particularly, to an exhaust treatment device having flow-promoting end caps.

BACKGROUND

Internal combustion engines, including diesel engines, gasoline engines, gaseous fuel-powered engines, and other engines known in the art exhaust a complex mixture of air pollutants. The air pollutants are composed of gaseous compounds, which include nitrogen oxides, carbon monoxide, and hydrocarbons, and solid particulate matter also known as soot. Due to increased awareness of the environment, emission standards have become more stringent, and the amount of gaseous compounds and particulate matter emitted from an engine may be regulated depending on the type of engine, size of engine, and/or class of engine.

One method that has been implemented by engine manufacturers to comply with the regulation of emissions has been to remove gaseous compounds and particulate matter from the exhaust flow of an engine using an exhaust treatment device. A typical exhaust treatment device generally includes a tubular housing having mounted therein a filter assembly designed to trap particulate matter and/or a catalyst to convert the gaseous compounds to innocuous gases. A first end cap with an integral inlet directs exhaust flow to the filter assembly, and a second end cap with an integral outlet directs exhaust flow away from the filter assembly. Depending on the size and shape of the filter and/or the geometry of the first and second end caps, pressure losses through the exhaust treatment device may be incurred that reduce the fuel efficiency of the associated engine. And, because these engines are often associated with vehicular applications, the pressure losses are typically the result of the size of shape of the exhaust treatment device due to tight space constraints within the vehicle's engine compartment.

Various filter and end cap designs have been proposed that attempt to reduce pressure losses within a space-conserving exhaust treatment device. For example, U.S. Pat. No. 5,144,797 (the '797 patent) issued to Swars on Sep. 8, 1992, describes a space-saving exhaust treatment device having a central treatment segment, an inlet segment communicated eccentrically with the central treatment segment, and an outlet segment communicated eccentrically with an opposing end of the central treatment segment. The central treatment segment is cylindrical and houses a honeycombed catalyst. The inlet and outlet segments are also cylindrical with a diameter about one-half to three-quarters of the central treatment segment's diameter. The inlet and outlet segments are oriented with respect to the central treatment segment at angles of about 90°, with the outlet segment positioned opposite the inlet segment such that the direction of the exhaust flow through the inlet segment is substantially parallel to the direction of the exhaust flow through the outlet segment. The configuration of the exhaust treatment device forces the flow of exhaust to travel in a spiral and/or helical pattern through the exhaust treatment device to reduce noise. Because the exhaust treatment device acts to reduce noise, the size of and/or need for mufflers in an exhaust system containing the exhaust treatment device may also be reduced, thereby reducing pressure losses associated with these mufflers.

While the exhaust treatment device of the '797 patent may conserve space and help to reduce the pressure losses in an exhaust system, its applicability may be limited. More specifically, the shape of the exhaust treatment device of the '797 patent may limit its placement within a vehicle by requiring the outlet segment to protrude from the device in a direction opposite the protrusion of the inlet segment. And, the profile of the inlet and outlet segment bends and/or the helical flow-promoting surfaces may be sub-optimal, and could actually increase pressure losses in the exhaust flow.

The exhaust treatment device of the present disclosure solves one or more of the problems set forth above.

SUMMARY OF THE INVENTION

One aspect of the present disclosure is directed to an end cap for an exhaust treatment device. The end cap may include a cylindrical housing having an axial direction, a radial direction substantially orthogonal to the axial direction, a first open end, and a second closed end opposing the first open end in the axial direction. The end cap may further include an integral port member extending from an annular surface of the cylindrical housing. The integral port member may include a central axis aligned in the radial direction, wherein an exterior surface of the integral port member tangentially connects to an exterior surface of the cylindrical housing.

Another aspect of the present disclosure is directed to a method of directing exhaust through a treatment device having an axial direction and a radial direction. The method may include directing exhaust into the treatment device in the radial direction and generating axial swirl in the exhaust. The method may also include directing the axially swirling exhaust in the axial direction through the treatment device and directing the exhaust out of the treatment device in the radial direction.

DETAILED DESCRIPTION

Figure 1:
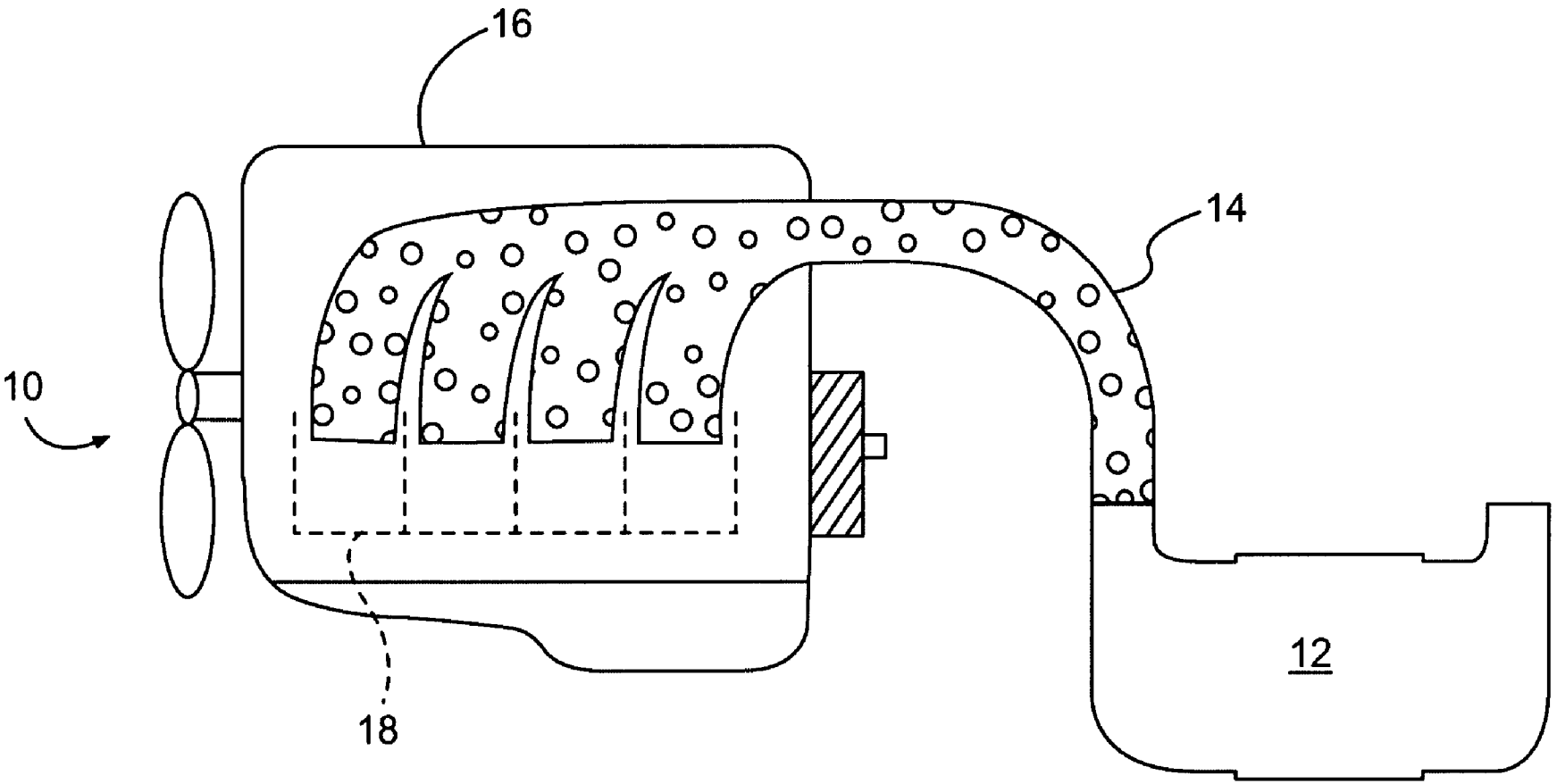
FIG. 1 is a diagrammatic illustration of an exemplary disclosed power system.

FIG. 1 illustrates a power unit 10 fluidly connected to an exhaust treatment device 12 via an exhaust passageway 14. Power unit 10 may embody, for example, an internal combustion engine that combusts a mixture of fuel and air to produce power and a flow of exhaust. For example, power unit 10 may be a diesel engine, a gasoline engine, or a gaseous fuel-powered engine. It is also contemplated that power unit 10 may alternatively be any other type of exhaust producing device such as a furnace, if desired.

Power unit 10 may include an engine block 16 that at least partially defines a plurality of cylinders 18. In the illustrated embodiment, power unit 10 includes four cylinders 18. However, it is contemplated that power unit 10 may include a greater or lesser number of cylinders 18 and that cylinders 18 may be disposed in an "in-line" configuration, a "V" configuration, or any other suitable configuration. A piston (not shown) may be situated within each cylinder 18 to compress the fuel-air mixture, which is then controllably combusted to produce the power output and flow of exhaust.

Figure 2A:
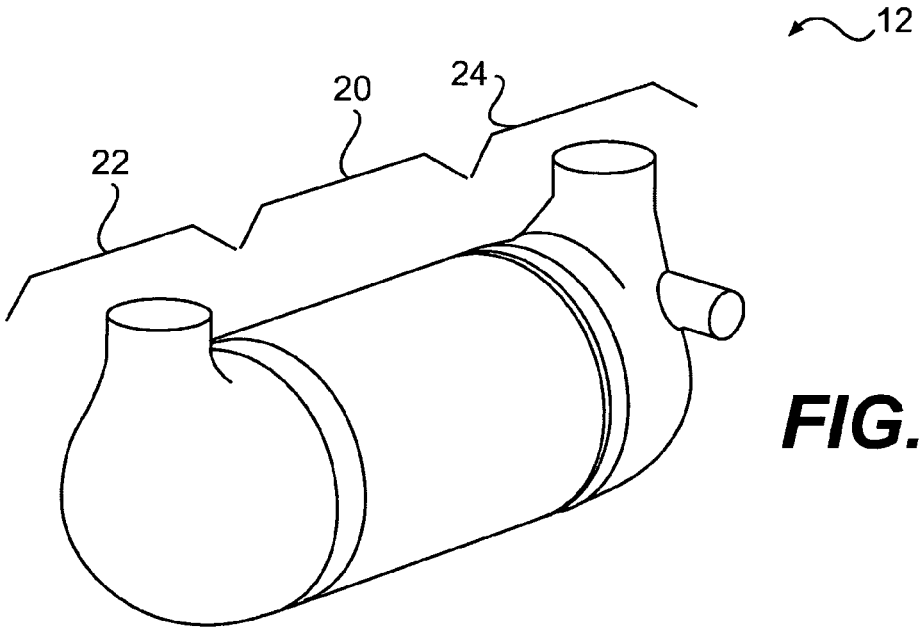
FIG. 2A is a pictorial illustration of an exemplary disclosed exhaust treatment device for use with the power system of FIG. 1.

As illustrated in FIG. 2A, exhaust treatment device 12 may include components that cooperate to receive and condition the exhaust from power unit 10. Specifically, exhaust treatment device 12 may include a main housing section 20, an inlet end cap 22, and an outlet end cap 24. Inlet end cap 22 may fluidly communicate exhaust passageway 14 with main housing section 20, while outlet end cap 24 may fluidly communicate main housing section 20 with the atmosphere. While passing through main housing section 20, constituents of the exhaust from power unit 10 may be removed from the flow and/or converted to innocuous gases. It is contemplated that inlet and outlet end caps 22, 24 may be connected to main housing section 20 by way of, for example, threaded fasteners, mounting pads, clamps, or any other means. It is further contemplated that additional exhaust treatment and/or attenuation mechanisms may be located upstream and/or downstream of exhaust treatment device 12, if desired.

Although not shown, main housing section 20 may contain a constituent-reducing element such as a ceramic honeycomb or wire mesh particulate filter and/or a catalyst device. For example, the particulate filter may be disposed within main housing section 20 to remove particulates from the exhaust flow, and the catalyst device may be disposed upstream or downstream of the particulate filter to absorb or convert nitrogen oxides, carbon monoxide, and/or hydrocarbons from the exhaust flow, to oxidize particulate matter in the exhaust flow during a regeneration event, or to remove or convert another exhaust constituent.

Main housing section 20 may be a hollow substantially cylindrical member having a central axis 28, a first open end 30, and a second open end 32 opposing first open end 30 in the axial direction (i.e., the flow direction substantially aligned with central axis 28). Exhaust from inlet end cap 22 may enter first open end 30 and exit second open end 32.

Inlet end cap 22 may also be a substantially cylindrical member with a first open end 34, and a second closed end 36. Both first open and second closed ends 34, 36 may be aligned with central axis 28 of main housing section 20, and arranged such that first open end 34 of inlet end cap 22 abuts first open end 30 of main housing section 20 and second closed end 36 is located distal from main housing section 20. Second closed end 36 may be fabricated to form a generally convex curved structure that is tangentially joined to an annular surface 38 at first open end 34. Although not required, an apex 40 at second closed end 36 may be radially aligned with central axis 28 of main housing section 20, if desired.

Inlet end cap 22 may include an integrally formed inlet port 42 for the radial direction of exhaust flow into exhaust treatment device 12. Inlet port 42 may embody a generally cylindrical member having a central axis 44 substantially aligned with a radial direction of main housing section 20 (i.e., central axis 44 of inlet port 42 may extend through central axis 28 of main housing section 20 to form an angle of about 90° therebetween). An outer annular wall portion 46 of inlet port 42 may be tangentially connected to the convex curved outer surface of second closed end 36. In this manner, exhaust entering inlet port 42 may be directed against and around the curved surface of inlet end cap 22 such that a reverse spiraling motion along central axis 28 is created, as represented by arrows 48. This reverse spiraling motion may create turbulence necessary to reduce drag within exhaust treatment device 12, which may directly relate to a pressure drop across exhaust treatment device 12. In this specific embodiment, outer annular wall portion 46 may be located at an axial location substantially aligned with apex 40 or past apex 40 relative to first open end 34.

Figure 2B:
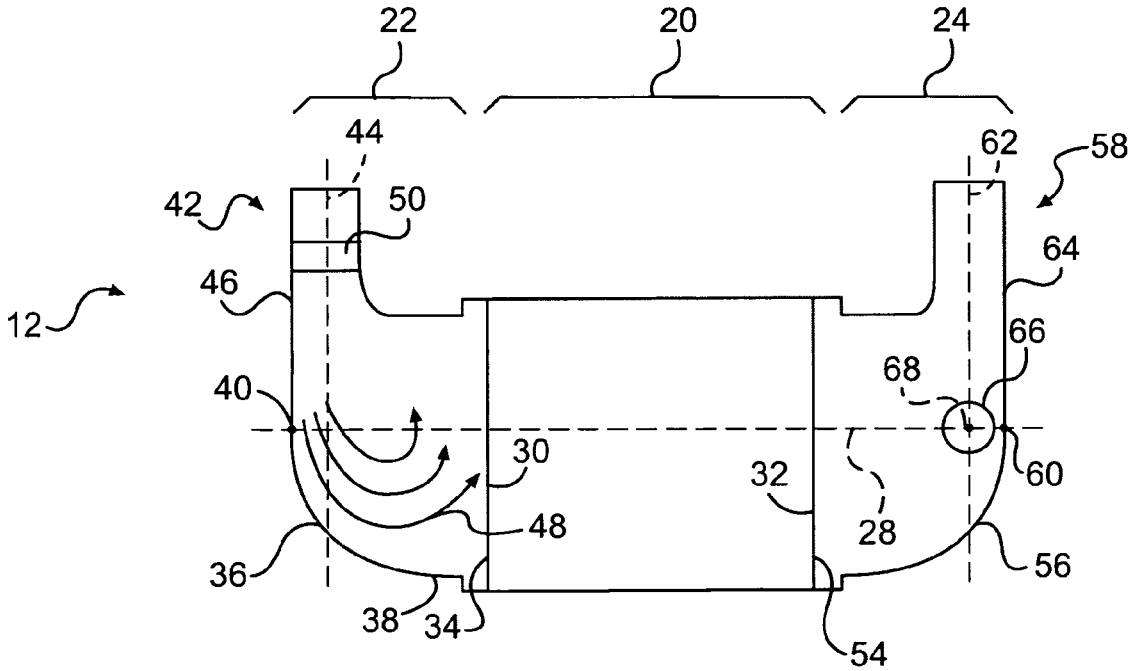
FIG. 2B is a side view, cross-section illustration of the exhaust treatment device of FIG. 2A.
Figure 2C:
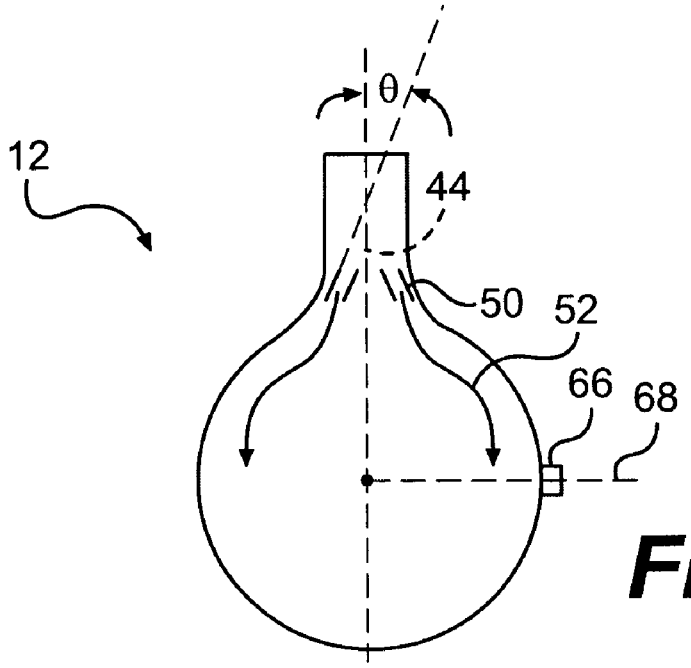
FIG. 2C is an end view cross-sectional illustration of the exhaust treatment device of FIG. 2A.

In addition to the reverse spiraling motion of the exhaust within treatment device, inlet port 42 may include a means for generating radial spiraling of the exhaust flow. Specifically, as illustrated in FIG. 2C, inlet port 42 may include one or more opposing vanes 50 disposed therein and angled outward relative to the flow of exhaust and central axis 44. Vanes 50 may be angled relative to central axis 44 by an angle θ. In one embodiment, angle θ may be in the range of about 20 degrees. With this configuration, exhaust entering inlet port 42 may be directed in opposing radial directions (relative to central axis 28) to generate a radial counter-spiraling of the exhaust, as represented by arrows 52. This spiraling may, in addition to furthering turbulence within exhaust treatment device 12, also facilitate equal distribution of the exhaust across the treatment devices within main housing section 20. While the embodiment of FIG. 2C illustrates four vanes 50, it is contemplated that any number of vanes 50 may be included within inlet port 42 or that vanes 50 may be completely omitted from inlet end cap 22, if desired.

Outlet end cap 24 may be substantially identical to inlet end cap 22, in that outlet end cap 24 may also include a first open end 54 and a second closed end 56, but with a cylindrical integral outlet port 58 instead of an inlet port. As with inlet end cap 22, second closed end 56 of outlet end cap 24 may be fabricated to form a generally convex curved structure having an apex 60 aligned with central axis 28 and a radial central axis 62 that passes through central axis 28. Apex 60 may be axially aligned with a distal annular surface 64 of outlet port 58 or located between distal annular surface 64 and first open end 54. The curved nature of outlet end cap 24 and the location of apex 60 may facilitate the low pressure exodus of exhaust from exhaust treatment device 12. Further, first open end 54 of outlet end cap 24 may abut second open end 32 of main housing section 20

In contrast to inlet end cap 22, outlet end cap 24 may omit vanes 50 and, instead, include an additional port 66. Port 66 may be associated with an exhaust gas recirculation system (not shown) used to redirect treated exhaust back into power unit 10. Port 66 may be located in the convex curved portion of outlet end cap 24, and include a central axis 68 that passes through and is oriented at about 90° to central axis 28. It is contemplated that port 66 may be omitted, if desired.

Figure 3:
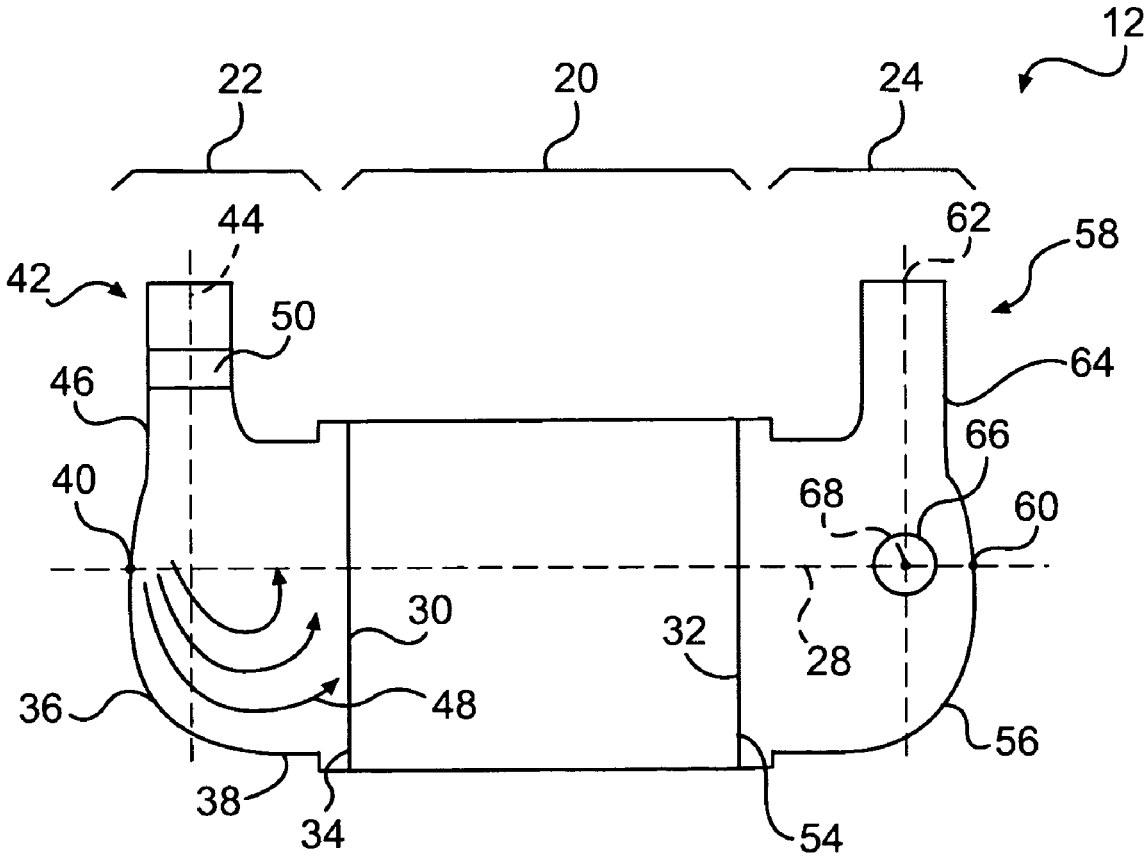
FIG. 3 is a side view, cross-section illustration of another exemplary disclosed exhaust treatment device.

An alternative embodiment of exhaust treatment device 12 is illustrated in FIG. 3. Similar to exhaust treatment device 12 of FIGS. 2A-2C, exhaust treatment device 12 of FIG. 3 may include a main housing section 20, an inlet end cap 22 having vanes 50 located within an integral inlet port 42, and an outlet end cap 24 having an integral outlet port 58 and exhaust gas recirculation port 66. However, in contrast to exhaust treatment device 12 of FIGS. 2A-2C, apexes 40 and 60 of FIG. 3 may be disposed in different axial relationships relative to inlet and outlet ports 42, 58. Specifically, apex 40 of inlet end cap 22 may be located a distance past inlet port 42 relative to first open end 34 and, similarly, apex 60 of outlet end cap 24 may be located a distance past outlet port 58 relative to first open end 54. This configuration may increase a volume of inlet and outlet end caps 22, 24 allowing for a reduced pressure drop and/or increased mixing and distribution across the treatment devices of main housing section 20.

Figure 4A:
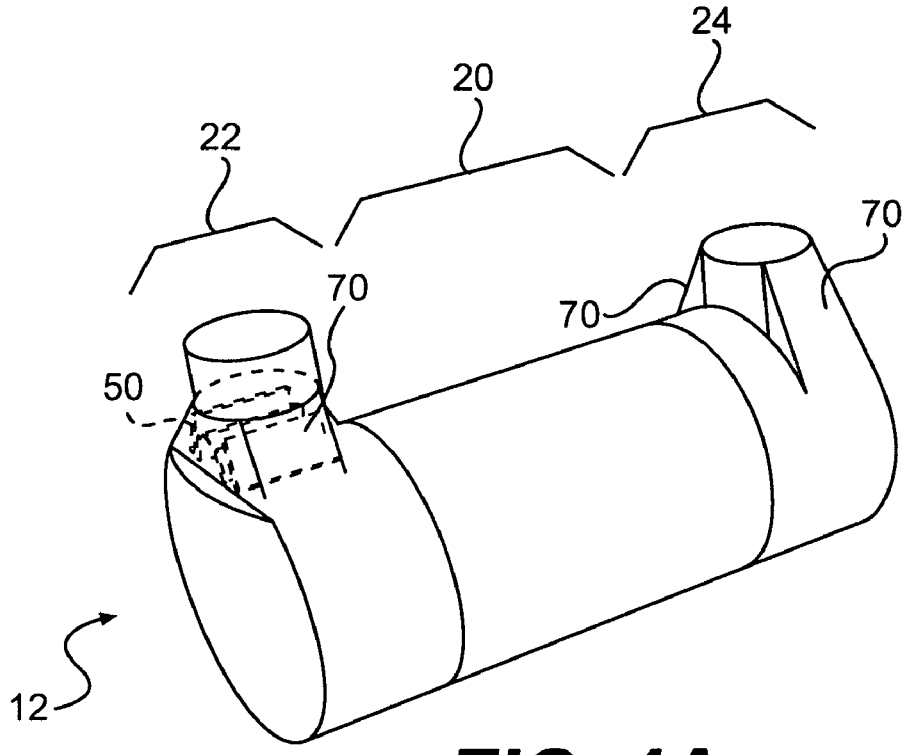
FIG. 4A is a pictorial illustration of yet another exemplary disclosed exhaust treatment device.
Figure 4B:
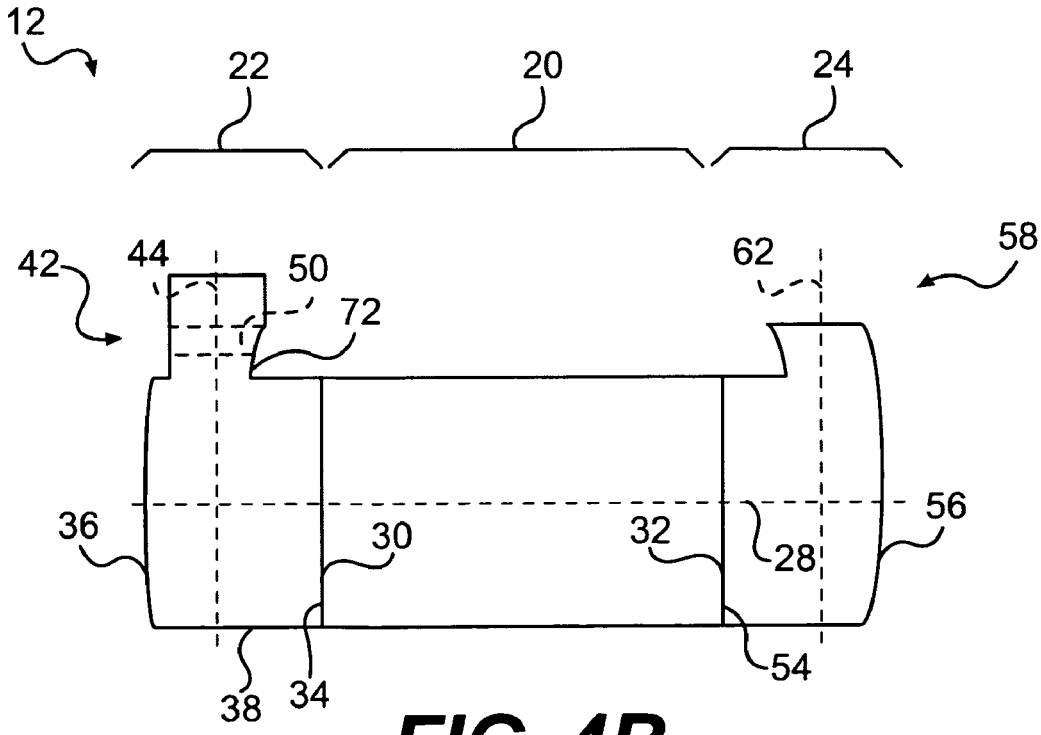
FIG. 4B is a side view, cross-section illustration of the exhaust treatment device of FIG. 4A.

FIG. 4A illustrates another alternative embodiment of exhaust treatment device 12. Similar to exhaust treatment device 12 of FIGS. 2A-2C and 3, exhaust treatment device 12 of FIG. 4A may include a main housing section 20, an inlet end cap 22 having vanes 50 located within an integral inlet port 42, and an outlet end cap 24 having an integral outlet port 58 and exhaust gas recirculation port 66. However, in contrast to exhaust treatment device 12 of FIGS. 2A-2C and 3, the convex curved structure of second closed ends 36 and 56 may be non-tangential with the annular surfaces at first open ends 34 and 54. In fact, it is contemplated that the convex curved structure of second closed ends 36 and 56 may even be omitted, if desired. In addition, integral inlet and outlet ports 42, 58 may each include opposing generally planar side surfaces 70. Each of side surfaces 70 may be angled from the open ends of inlet and outlet ports 42, 58 to tangentially connect their respective inlet and outlet ports 42, 58 to the annular outer surfaces extending from first open ends 34 and 54. In addition, as best illustrated in FIG. 5B, one or both of inlet and outlet ports 42, 58 may include a generally planar deflection surface 72 that extends from an annular outer portion of the respective ports inward toward the central axis thereof such that a diameter of the ports in the axial direction is decreased. When located within inlet port 42, deflection surface 72 may redirect radially incoming exhaust axially toward the curved structure of second closed end 36 to increase the magnitude of the resulting swirl. It is contemplated that, in the embodiment of FIGS. 4A and 4B, a distal annular surface of inlet port 42 may be non-tangential with the convex curved structure of second closed end 36, if desired. In fact, the distal annular surface of inlet port 42 may actually join to the annular cylindrical surface that extends from first open end 34.

INDUSTRIAL APPLICABILITY

The disclosed end cap design may be applicable to any exhaust treatment device where low pressure drop across the device is desired. Although suitable for use with any exhaust treatment device, the disclosed end cap design may be particularly applicable to vehicular applications where the conservation of space under the vehicle or within an engine compartment is a concern. The disclosed end cap design may promote a well-distributed flow of exhaust that minimizes pressure loss by inducing both axial and radial swirl in the flow. The operation of power unit 10 will now be explained.

Referring to FIG. 1, air and fuel may be drawn into cylinders 18 of power unit 10 for subsequent compression and combustion that produces a mechanical work output and an exhaust flow of hot gases. The exhaust flow may contain a complex mixture of air and gaseous and solid pollutants, which may be directed from power unit 10 to exhaust treatment device 12 by way of exhaust passageway 14.

As the exhaust enters treatment device 12 by way of inlet port 42 (referring to FIGS. 2A-C, 3, 4A, and 4B), it may be caused to swirl in axial and/or radial directions. That is, the incoming exhaust may be directed by vanes 50 and/or deflection surface 72 (referring specifically to FIGS. 4A and 4B) radially outward in opposing directions and axially toward the curved surface of second closed end 36, respectively. From inlet end cap 22, the swirling exhaust may be passed through main housing section 20, treated by the elements therein, and exit exhaust treatment device 12 via outlet port 58 of outlet end cap 24.

The above-disclosed inlet and outlet end cap embodiments may serve to conserve space within an engine system, while reducing pressure losses across the exhaust treatment device. More specifically, although outlet end cap may be re-oriented to allow an exit flow of exhaust in the same general direction as an inlet flow of exhaust, this specific orientation is not required. The flexibility of the inflow and outflows of exhaust may accommodate a variety of engine configuration types and, subsequently, reduce the space required by exhaust treatment device 12. In addition, the radial and axial swirl-promoting geometry of the end caps may increase turbulence within the device, thereby reducing drag and the associated pressure losses. And, the radial and axial swirling of exhaust may facilitate even distribution of exhaust across the treatment elements of main housing section 20, such that more efficient treatment of the exhaust may be realized, along with longer component life of the elements.

It will be apparent to those skilled in the art that various modifications and variations can be made to the exhaust treatment device of the present disclosure without departing from the scope of the disclosure. Other embodiments will be apparent to those skilled in the art from consideration of the specification and practice of the exhaust treatment device disclosed herein. It is intended that the specification and examples be considered as exemplary only, with a true scope of the disclosure being indicated by the following claims and their equivalents.

What is claimed is:

1. An end cap for an exhaust treatment device, comprising:

a cylindrical housing having an axial direction, a radial direction substantially orthogonal to the axial direction, a first open end, and a second closed end opposing the first open end in the axial direction, the second closed end including a convex curved outer portion having an apex substantially aligned with a central axis aligned in the axial direction of the cylindrical housing;

an integral port member extending from an annular surface of the cylindrical housing and having a central axis aligned in the radial direction and an exterior surface tangentially connected to an exterior surface of the cylindrical housing at the second closed end, wherein an outer annular surface of the integral port member distal from the first open end is located at about the same axial distance from the first open end as the apex of the convex curved outer portion.

2. The end cap of claim 1, wherein the convex curved outer surface is tangentially joined to an annular portion of the cylindrical housing that extends from the first open end.

3. The end cap of claim 1, further including a second integral port member having an opening and a central axis extending in a direction substantially orthogonal to the axial direction.

4. The end cap of claim 3, wherein the second closed end includes a convex curved outer surface, and the second integral port member extends from the convex curved outer surface.

5. The end cap of claim 1, further including at least one vane member disposed within the integral port member.

6. The end cap of claim 5, wherein the at least one vane member is disposed at an angle relative to the radial direction such that fluid passing over the at least one vane member is directed away from a central axis of the cylindrical housing.

7. The end cap of claim 6, wherein the at least one vane member includes a plurality of vane members located on opposing sides of the central axis.

8. The end cap of claim 1, wherein a diameter at an inlet opening of the integral port member is greater than a diameter at a location where the integral port member joins the cylindrical housing.

9. The end cap of claim 8, wherein the integral port member includes an outer surface angled toward the central axis such that fluid passing through the integral port member is directed along a direction parallel to the axial direction.

10. The end cap of claim 1, wherein a flow of exhaust through the end cap has both a radial and an axial swirl component.

11. An end cap for an exhaust treatment device, comprising:

a cylindrical housing having an axial direction, a radial direction substantially orthogonal to the axial direction, a first open end, and a second closed end opposing the first open end in the axial direction, the second closed end including a convex curved outer portion having an apex substantially aligned with a central axis aligned in the axial direction of the cylindrical housing;

an integral port member extending from an annular surface of the cylindrical housing and having a central axis aligned in the radial direction and an exterior surface tangentially connected to an exterior surface of the cylindrical housing at the second closed end, wherein the apex of the convex curved outer portion is located an axial distance away from the first open end that is greater than an axial distance from a distal annular surface of the integral port member to the first open end.

12. The end cap of claim 11, wherein the convex curved outer surface is tangentially joined to an annular portion of the cylindrical housing that extends from the first open end.

13. The end cap of claim 11, further including a second integral port member having an opening and a central axis extending in a direction substantially orthogonal to the axial direction.

14. The end cap of claim 13, wherein the second closed end includes a convex curved outer surface, and the second integral port member extends from the convex curved outer surface.

15. The end cap of claim 11, further including at least one vane member disposed within the integral port member.

16. The end cap of claim 15, wherein the at least one vane member is disposed at an angle relative to the radial direction such that fluid passing over the at least one vane member is directed away from a central axis of the cylindrical housing.

17. The end cap of claim 16, wherein the at least one vane member includes a plurality of vane members located on opposing sides of the central axis.

18. The end cap of claim 11, wherein a diameter at an inlet opening of the integral port member is greater than a diameter at a location where the integral port member joins the cylindrical housing.

19. The end cap of claim 18, wherein the integral port member includes an outer surface angled toward the central axis such that fluid passing through the integral port member is directed along a direction parallel to the axial direction.

20. The end cap of claim 11, wherein a flow of exhaust through the end cap has both a radial and an axial swirl component.

* * * * *